US006100485A

United States Patent [19]

Mortun et al.

[11] Patent Number: 6,100,485

[45] Date of Patent: Aug. 8, 2000

[54] ROTARY DISCONNECT SWITCH DEVICE FOR TRANSFORMING ROTARY MOTION INTO LINEAR MOTION TO OPEN AND CLOSE ELECTRICAL CONTACTS

[75] Inventors: Sorin I. Mortun, Irvington, N.Y.; Jeffrey L. Winterstein, Terryville, Conn.

[73] Assignee: Hubbell Incorporated, Orange, Conn.

[21] Appl. No.: 09/357,428

[22] Filed: Jul. 20, 1999

[51] Int. Cl.[7] ..... H01H 21/84

[52] U.S. Cl. ..... 200/572; 200/16 R; 200/4

[58] Field of Search ..... 200/16 R, 4, 17 R, 200/11 R, 116, 114, 115, 564–572, 336, 573, 574

[56] References Cited

U.S. PATENT DOCUMENTS

| | | | |
|---|---|---|---|
| 4,052,582 | 10/1977 | Mullen et al. | 200/330 |
| 4,225,765 | 9/1980 | Johnston et al. | 200/307 |
| 5,736,698 | 4/1998 | Mattlar et al. | 200/16 R |
| 5,886,311 | 3/1999 | Morel et al. | 200/17 R |
| 5,934,455 | 8/1999 | Vuorinen | 200/430 |

*Primary Examiner*—Michael Friedhofer
*Attorney, Agent, or Firm*—Jerry M. Presson; Michael R. Swartz

[57] ABSTRACT

A rotary disconnect switch device includes a housing, a handle mounted to the housing to undergo rotatable movement between on and off positions, and a rotary disconnect assembly supported in the housing below the handle. The rotary disconnect assembly includes pairs of electrical contact terminals each having respective contact elements movably and stationarily mounted on a main base for undergoing relative movement along a longitudinal axis of rotation of the handle so as to switch their respective contact elements between closed and opened conditions. The main cam follower is movably supported on the main base for undergoing reciprocable linear movement along the longitudinal axis toward and away from the movable contact terminals so as to produce movement thereof relative to the stationary contact terminals such that the respective contact elements are switched between the closed and opened conditions. The main cam actuator is rotatably supported on the main base between the main cam follower and inner coupler portion of the handle and has an upper coupler portion facing toward an inner coupler portion of the handle and intercoupled therewith such that the main cam actuator will undergo rotation about the longitudinal axis of the handle with rotation of the handle and respectively produce the reciprocal linear movement of the main cam follower along the longitudinal axis and switch the respective contact elements between closed and opened conditions as the handle is rotated between on and off positions.

20 Claims, 10 Drawing Sheets

ROTARY DISCONNECT SWITCH DEVICE FOR TRANSFORMING ROTARY MOTION INTO LINEAR MOTION TO OPEN AND CLOSE ELECTRICAL CONTACTS

BACKGROUND OF THE INVENTION

1. Field of the Invention

The present invention generally relates to wiring devices, such as rotary switches and, more particularly, is concerned with a rotary disconnect switch device for transforming rotary motion into linear motion in order to open and close electrical contacts.

2. Description of the Prior Art

For many years a comprehensive selection of electrical and electronic products for commercial, industrial, institutional, utility and telecommunications applications have been manufactured and sold by Hubbell Incorporated, the assignee of the present invention. Included among these products are a variety of wiring devices, such as single, two and three pole, three and four way, motor starting, rotary and other types of switches.

A rotary switch is a type of switch having an actuating member that when turned in a given direction completes a circuit in which the rotary switch is connected and when turned in an opposite directions or further in the same direction interrupts the same circuit. In such manner, an electrical device, such as a motor, also connected in the circuit with the rotary switch may be correspondingly turned on and off. Typically, the circuit is completed and interrupted through the making or breaking of electrical contacts.

The rotary switches manufactured and sold heretofore by Hubbell Incorporated have, generally speaking, met with great success in the marketplace. However, from time to time innovations to expand the capabilities of even successful products, such as rotary switches, are needed.

SUMMARY OF THE INVENTION

The present invention provides a rotary disconnect switch device designed to satisfy the aforementioned need. The switch device of the present invention employs several innovations which expand the capability thereof. One innovation is the incorporation of a rotary disconnect assembly that transforms rotary motion into linear motion in order to open and close electrical contacts of a main switch of the device. Another innovation is the option to incorporate an auxiliary switch to function with the rotary disconnect assembly. These innovations permit the switch device to be used in a variety of applications ranging from primary on-off motor control to a local safety disconnect.

Accordingly, the present invention is directed to a rotary disconnect switch device which comprises: (a) a housing; (b) a handle having a longitudinal axis of rotation and being mounted to the housing for undergoing rotatable movement about the longitudinal axis between on and off positions relative to the housing, the handle having an outer knob portion disposed exteriorly of the housing for gripping by an operator to turn the handle and an inner coupler portion disposed interiorly of the housing; and (c) a rotary disconnect assembly supported in the housing below the handle. The rotary disconnect assembly includes (i) a main base, (ii) means for stationarily supporting the main base in the housing below the inner coupler portion of the handle, (iii) at least one pair of electrical contact terminals having respective contact elements and being respectively movably and stationarily mounted on the main base for undergoing relative movement with respect to one another in a direction generally along the longitudinal axis of the handle so as to switch the respective contact elements of the contact terminals between closed and opened conditions, (iv) a main cam follower movably supported on the main base for undergoing reciprocable linear movement along the longitudinal axis of the handle toward and away from the movable contact terminal so as to produce movement thereof relative to the stationary contact terminal such that the respective contact elements are switched between the closed and opened conditions, and (v) a main cam actuator rotatably supported on the main base between the main cam follower and the inner coupler portion of the handle and having an upper coupler portion facing toward the inner coupler portion of the handle and intercoupled therewith such that the main cam actuator will undergo rotation about the longitudinal axis with rotation of the handle and respectively produce the reciprocal linear movement of the main cam follower along the longitudinal axis of the handle and thereby switch the respective contact elements of the contact terminals between the closed and opened conditions as the handle is rotated between its on and off positions.

More particularly, the main cam follower has at least one inclined lower surface adapted to engage and move the movable contact terminal relative to the stationary contact terminal. The means for stationarily supporting the main base in the housing is a yoke member having a generally U-shaped configuration.

The device further comprises a pair of lateral cam followers disposed on opposite sides of the main cam actuator and having respective protrusions formed on and extending from inner sides of the lateral cam followers toward one another and means for biasing the lateral cam followers toward the opposite sides of the main cam actuator. The main cam actuator has projections formed on and extending outwardly from opposite sides of the main cam actuator in opposite directions such that upon rotation of the handle and the main cam actuator therewith to a rotated position so as to switch the respective contact elements of the contact terminals to one of the closed and opened conditions the projections of the main cam actuator engage with the respective protrusions on the lateral cam followers so as to releasably retain the main cam actuator and the handle therewith at the rotated position.

The device also may comprise an auxiliary base supported in the housing below the inner coupler portion of the handle and a cam shaft adapter rotatably supported in the auxiliary base and having one end portion coupled to the inner coupler portion of the handle and an opposite end portion coupled to the upper coupler portion of the main cam actuator. The device further can have at least one and preferably a pair of auxiliary switches mounted on the auxiliary base adjacent to the cam shaft adapter and switched by the cam shaft adapter between on and off conditions in response to rotational movement of the handle between the on and off positions.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
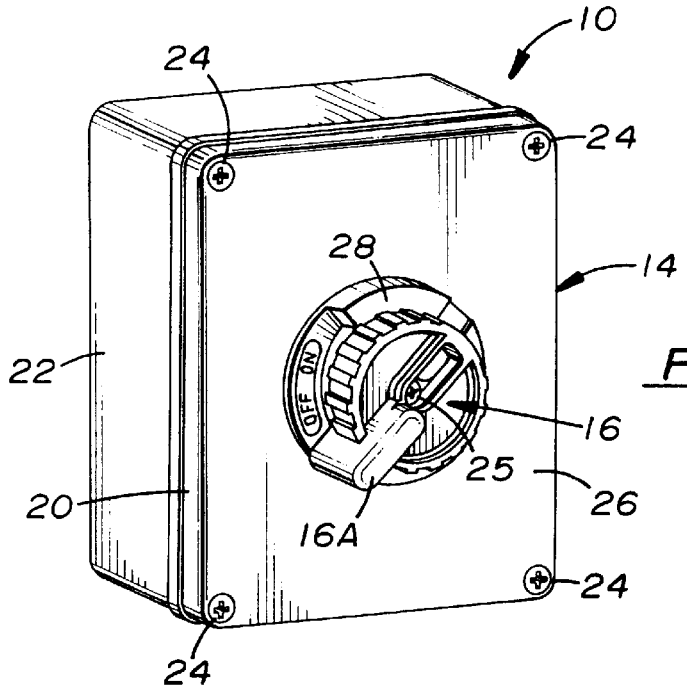
FIG. 1 is an assembled perspective view of an exemplary embodiment of a rotary disconnect switch device of the present invention for transforming rotary motion into linear motion in order to open and close a plurality of electrical contacts.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Referring to the drawings and particularly to FIGS. 1 to 5, there is illustrated a rotary disconnect switch device of the present invention, generally designated 10, which is operable to transform rotary movement of an external component of the device 10, when turned by an operator, into linear motion of an internal component of the device 10 in order to open and close at least one and preferably a plurality of pairs of electrical contact terminals, generally designated 12A, 12B. The switch device 10 basically includes a housing 14, a handle 16 having a central longitudinal axis of rotation A and being mounted to the housing 14 to undergo rotary movement when turned by the operator about the longitudinal rotational axis A between on and off positions relative to the housing 14, and a rotary disconnect assembly 18 supported in the housing 14 below the handle 16.

The housing 14 of the switch device 10 is provided by a cover 20 and a box 22 detachably attached to one another by corner fasteners 24. The housing 14 has a generally rectangular configuration, although it is not so limited and may have any other suitable configuration. The handle 16 of the switch device 10 has an outer knob portion 16A disposed exteriorly of the cover 20 of the housing 14 for gripping by the operator to turn or rotate the handle 16. The handle 16 also has an inner coupler portion 16B with circumferentially spaced and outwardly protruding lugs 16C defined thereon. The inner coupler portion 16B is disposed interiorly of the box 22 of the housing 14 and extending through a central opening 20A in an end panel 26 of the cover 20 and attached to the outer knob portion 16A of the handle 16 by a handle screw 25. The handle 16 is mounted on the end panel 26 of the enclosure cover 20 by an outer escutcheon 28 and an inner panel mounting plate 30 fastened by screws 32 to one another so as to sandwich the end panel 26 of the cover 20 therebetween. The outer knob portion 16A of the handle 16 is rotatably mounted to the outer escutcheon 28 which has the "on-off" positions of the handle 16 marked thereon, as best seen in FIG. 1.

Figure 2:
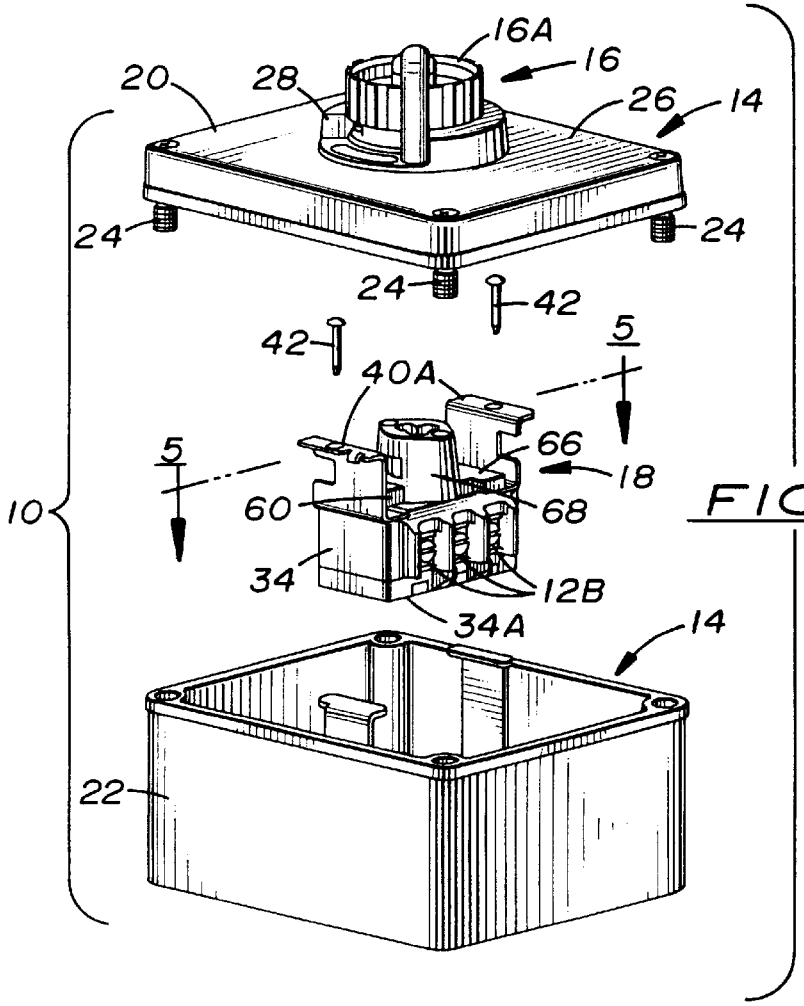
FIG. 2 is an exploded perspective view of the rotary disconnect switch device showing a housing with a cover and box, a handle rotatable mounted on the cover and a rotary disconnect assembly disposed between the cover and box.
Figure 3:
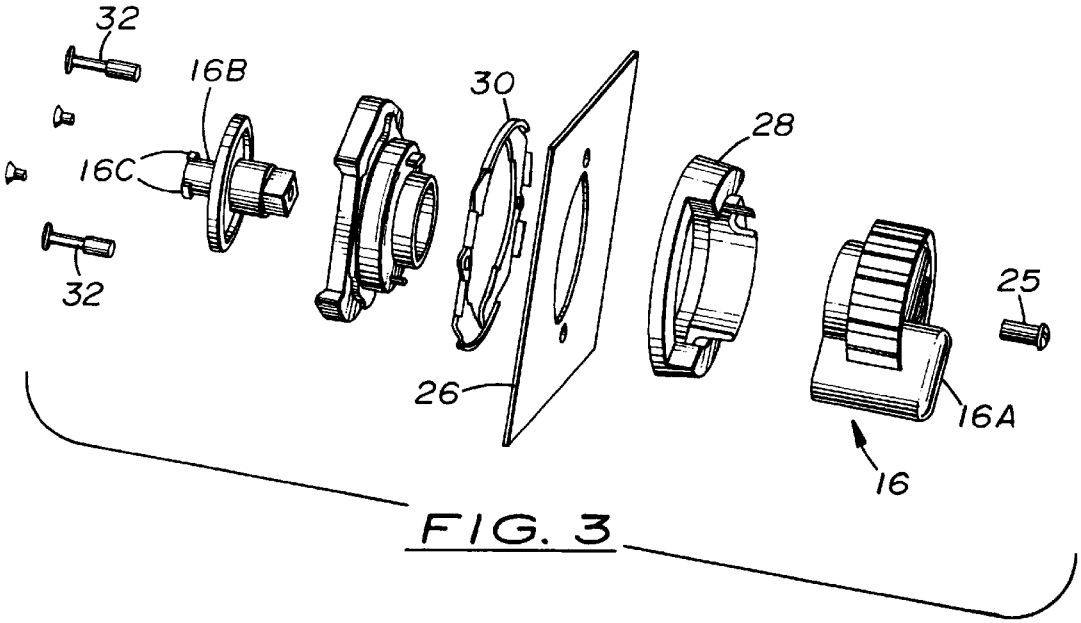
FIG. 3 is an exploded perspective view of the handle and housing cover of the switch device.
Figure 13:
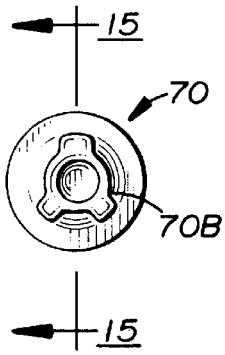
FIG. 13 is a bottom plan view of the cam shaft adapter as seen alone 13—13 of FIG. 12.
Figure 12:
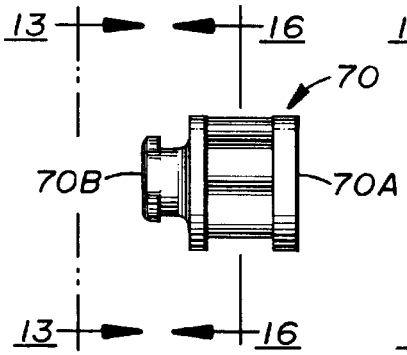
FIG. 12 is a side elevational view of the cam shaft adapter as seen along line 12—12 of FIG. 11.
Figure 11:
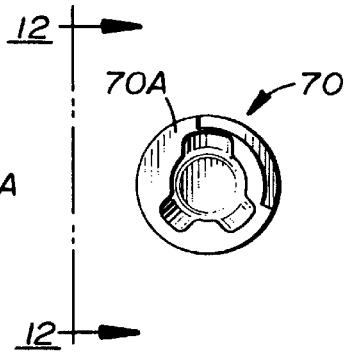
FIG. 11 is an enlarged top plan view of a cam shaft adapter of the assembly as seen along line 11—11 of FIG. 4.
Figure 14:
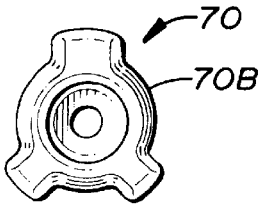
FIG. 14 is an enlarged detailed view of the bottom end of the cam shaft adapter as seen in FIG. 13.
Figure 15:
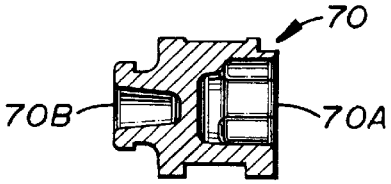
FIG. 15 is a longitudinal sectional view of the cam shaft adapter taken along line 15—15 of FIG. 13.
Figure 16:
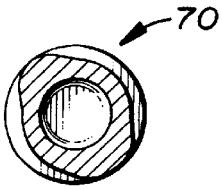
FIG. 16 is a transverse section view of the cam shaft adapter taken along line 16—16 of FIG. 12.
Figure 4:
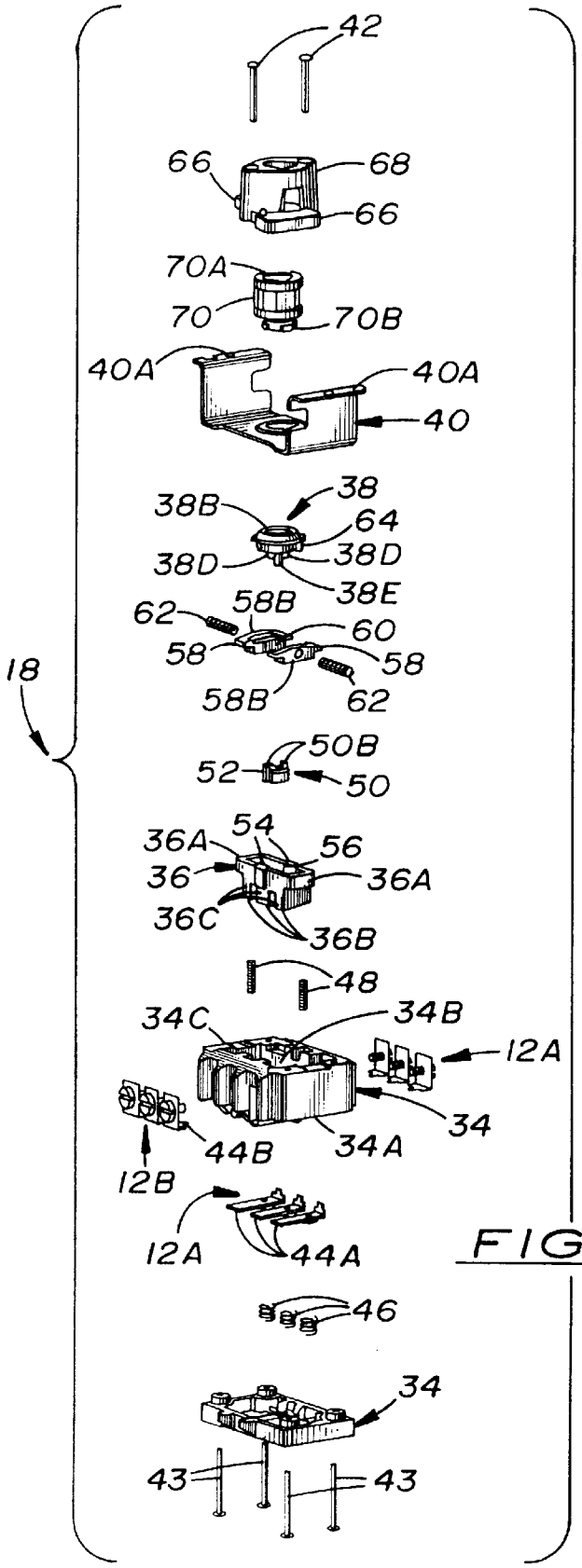
FIG. 4 is an exploded perspective view of the rotary disconnect assembly of FIG. 2 but on a smaller scale.
Figure 5:
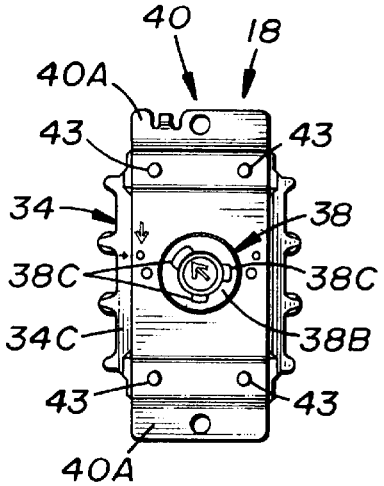
FIG. 5 is an assembled top plan view of the rotary disconnect assembly as seen along line 5—5 of FIG. 2 with an auxiliary base, cam shaft adapter and auxiliary switches omitted.
Figure 6:
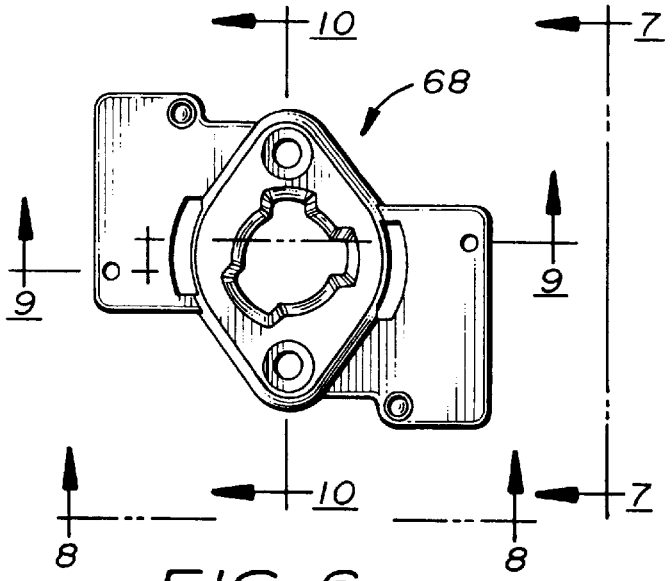
FIG. 6 is an enlarged top plan view of an auxiliary base of the assembly as seen along line 6—6 of FIG. 4 for mounting a pair of auxiliary switches as seen in FIG. 2.
Figure 7:
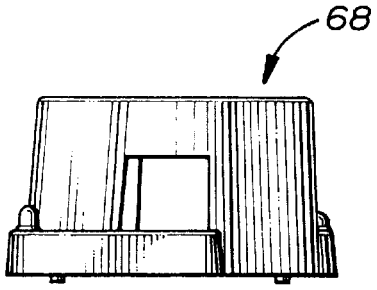
FIG. 7 is a side elevational view of the auxiliary base as seen along line 7—7 of FIG. 6.
Figure 8:
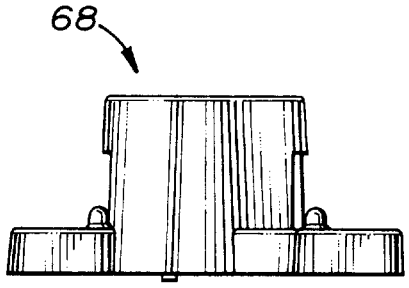
FIG. 8 is another side elevational view of the auxiliary base as seen along line 8—8 of FIG. 6.
Figure 10:
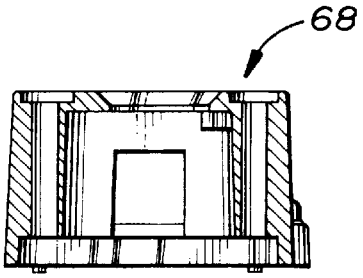
FIG. 10 is another longitudinal sectional view of the auxiliary base taken along line 10—10 of FIG. 6.
Figure 9:
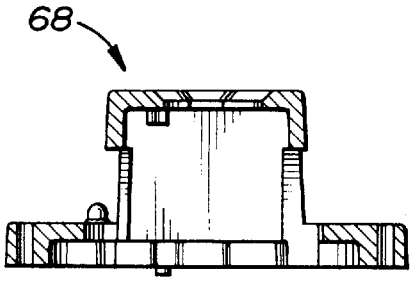
FIG. 9 is a longitudinal sectional view of the auxiliary base taken along line 9—9 of FIG. 6.
Figure 17:
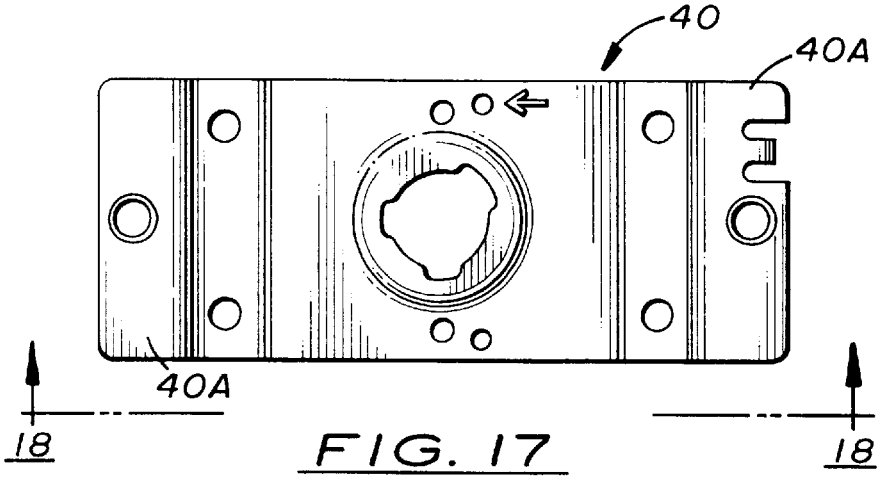
FIG. 17 is an enlarged top plan view of a yoke member of the assembly as seen along line 17—17 of FIG. 4.
Figure 18:
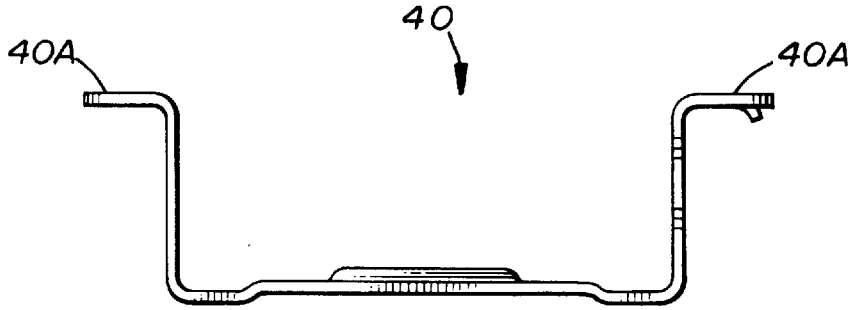
FIG. 18 is a side elevational view of the yoke member as seen along line 18—18 of FIG. 17.
Figure 19:
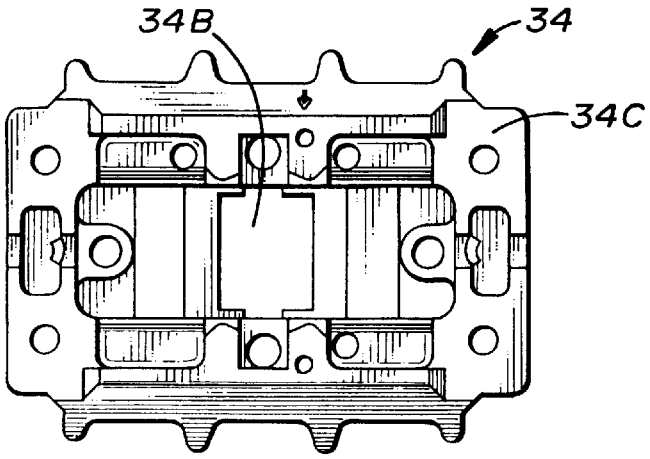
FIG. 19 is an enlarged top plan view of a main base of the assembly as seen along line 19—19 of FIG. 4 for mounting a plurality of contacts constituting a main switch of the switch device.
Figure 21:
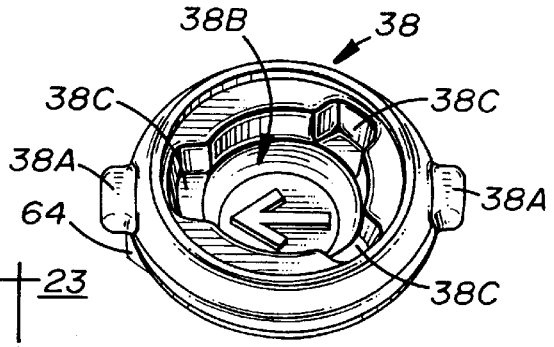
FIG. 21 is a perspective view of the main cam actuator.
Figure 20:
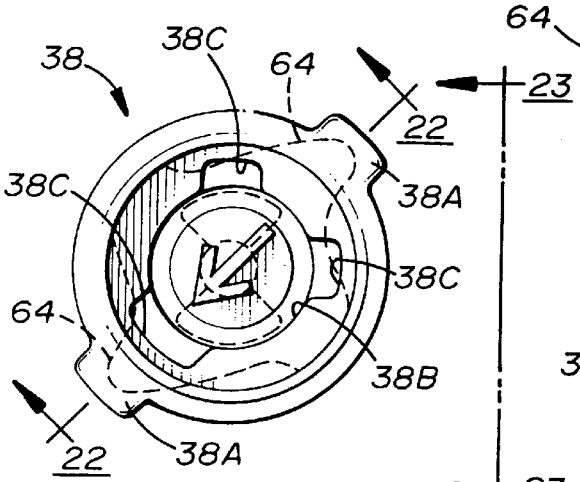
FIG. 20 is an enlarged top plan view of a main cam actuator of the assembly as seen along line 20—20 of FIG. 4.
Figure 22:
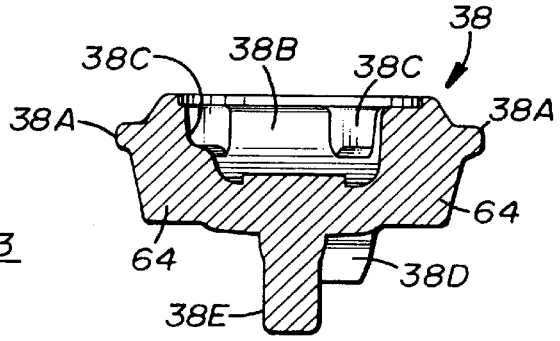
FIG. 22 is a longitudinal sectional view of the main cam actuator taken along line 22—22 of FIG. 20.
Figure 23:
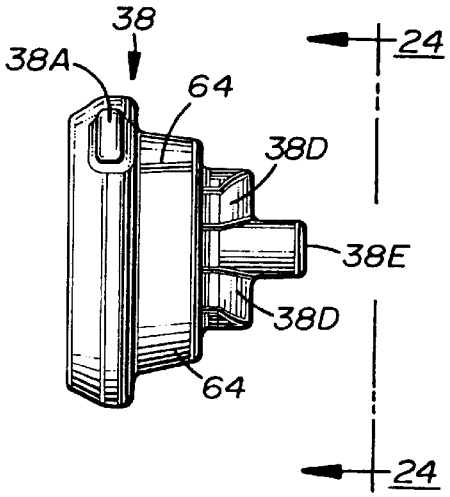
FIG. 23 is a side elevational view of the main cam actuator as seen along line 23—23 of FIG. 20.
Figure 24:
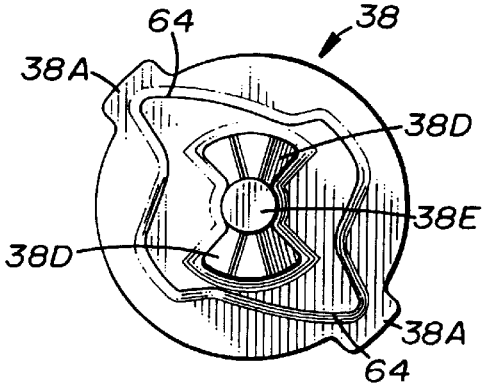
FIG. 24 is a bottom plan view of the main cam actuator as seen along line 24—24 of FIG. 23.
Figure 31:
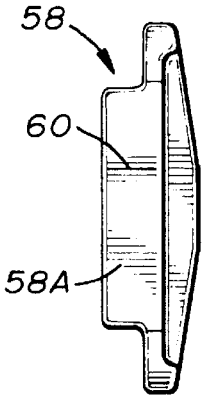
FIG. 31 is an inner side elevational view of the lateral cam follower as seen along line 31—31 of FIG. 30.
Figure 30:
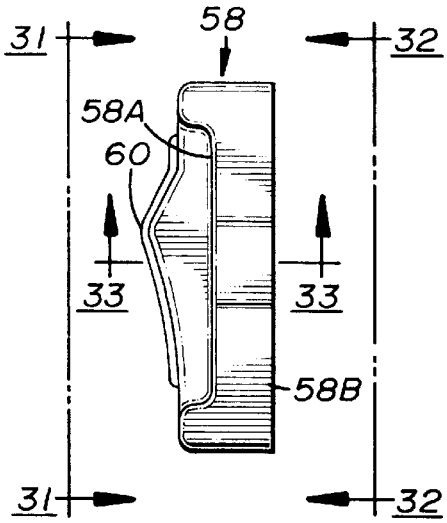
FIG. 30 is an enlarged top plan view of one of a pair of lateral cam followers of the assembly as seen along line 30—30 of FIG. 4.
Figure 32:
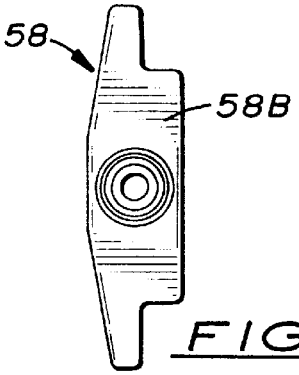
FIG. 32 is an outer side elevational view of the lateral cam follower as seen along line 32—32 of FIG. 30.
Figure 33:
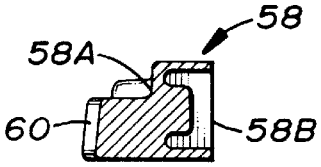
FIG. 33 is a transverse sectional view of the lateral cam follower taken along line 33—33 of FIG. 30.
Figure 25:
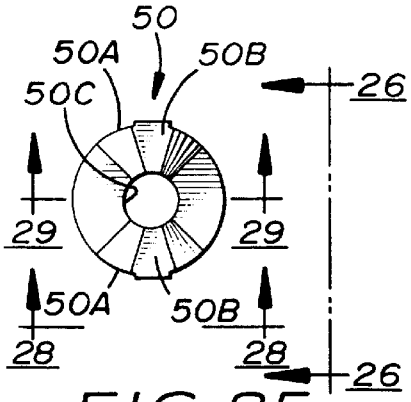
FIG. 25 is an enlarged top plan view of a cam follower insert of the assembly as seen along line 25—25 of FIG. 4.
Figure 26:
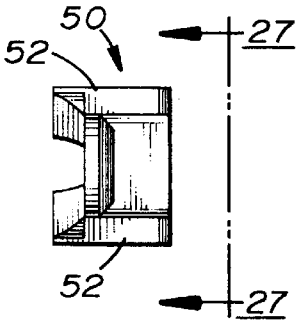
FIG. 26 is a side elevational view of the cam follower insert as seen along line 26—26 of FIG. 25.
Figure 27:
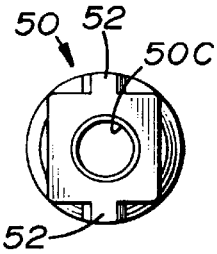
FIG. 27 is a bottom plan view of the cam follower insert as seen along line 27—27 of FIG. 26.
Figure 29:
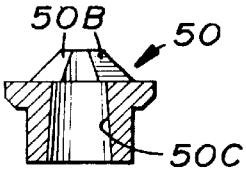
FIG. 29 is a longitudinal sectional view of the cam follower insert taken along line 29—29 of FIG. 25.
Figure 28:
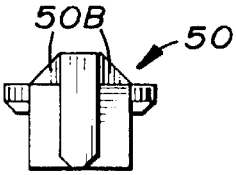
FIG. 28 is another side elevational view of the cam follower insert as seen along line 28—28 of FIG. 25.
Figure 37:
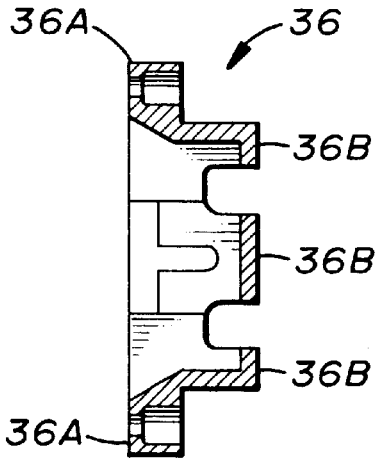
FIG. 37 is a longitudinal sectional view of the main cam follower taken along line 37—37 of FIG. 34.
Figure 34:
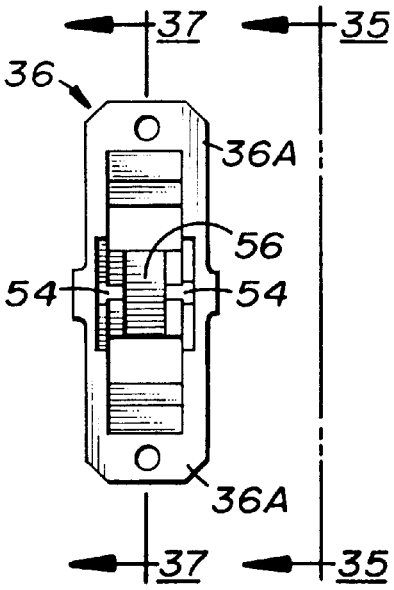
FIG. 34 is an enlarged top plan view of a main cam follower of the assembly as seen along line 34—34 of FIG. 4.
Figure 35:
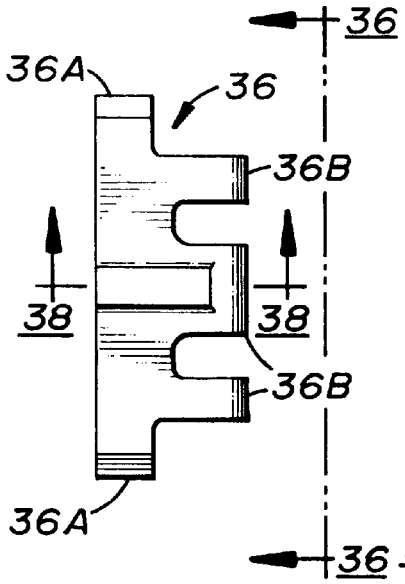
FIG. 35 is a side elevational view of the main cam follower as seen along line 35—35 of FIG. 34.
Figure 36:
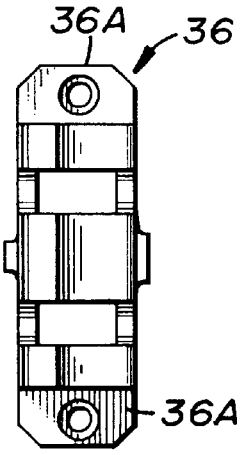
FIG. 36 is a bottom plan view of the main cam follower as seen along line 36—36 of FIG. 35.
Figure 38:
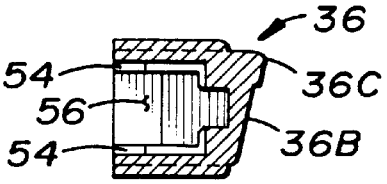
FIG. 38 is a transverse sectional view of the main cam follower taken along line 38—38 of FIG. 35.
Figure 39:
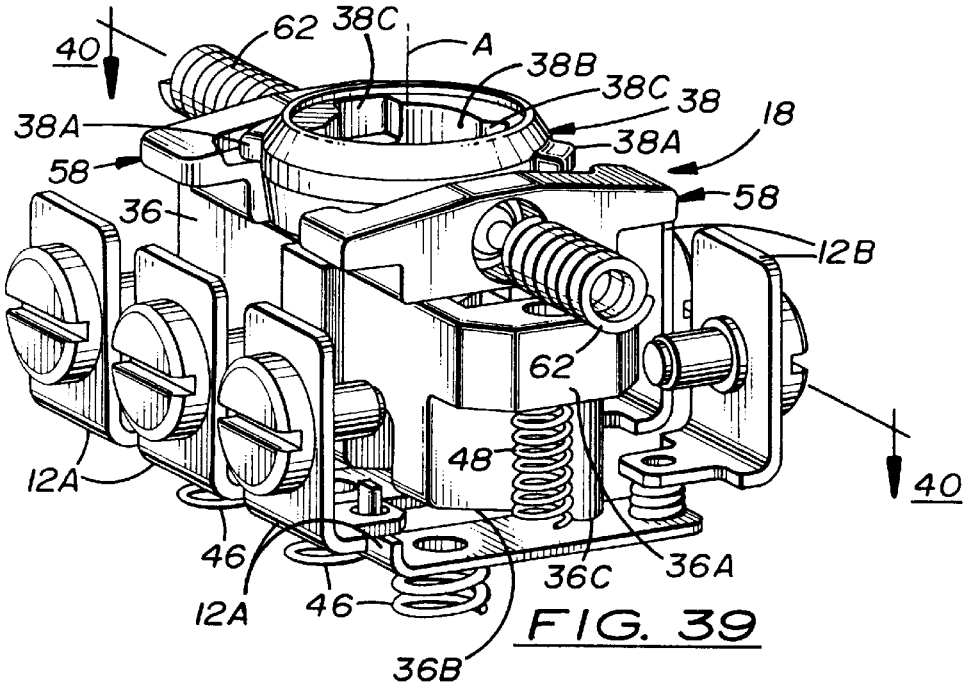
FIG. 39 is an assembled perspective view of the rotary disconnect assembly with the auxiliary base, auxiliary switches, cam shaft adapter and yoke member thereof omitted.
Figure 40:
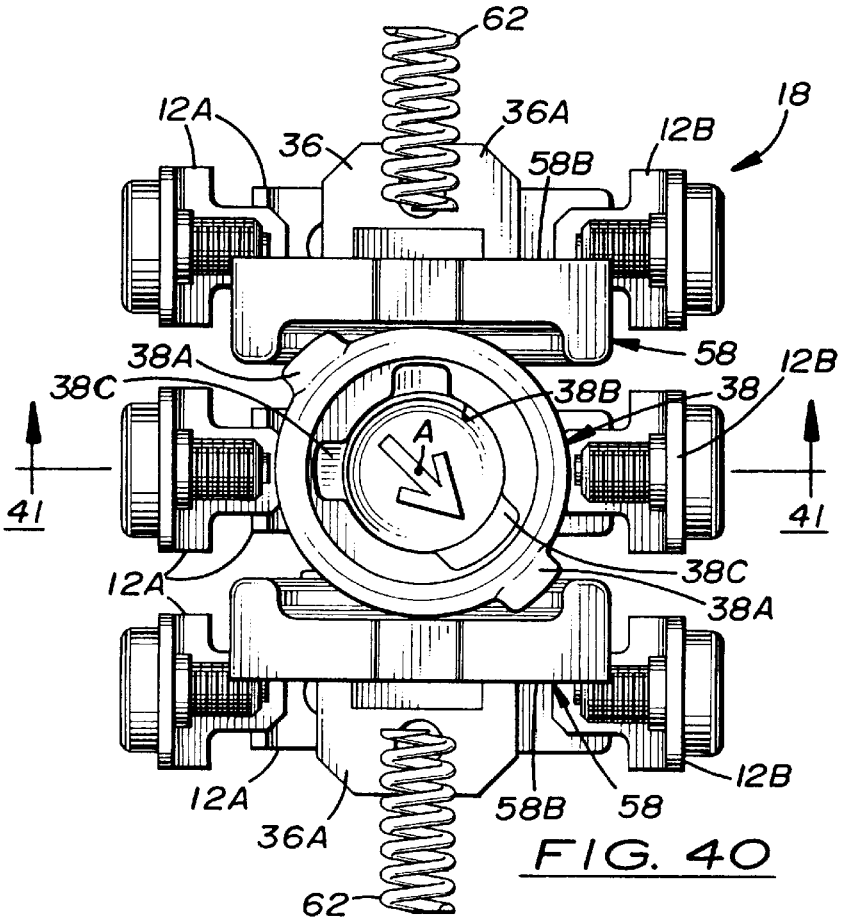
FIG. 40 is a top plan view of the assembly as seen along line 40—40 of FIG. 39.
Figure 41:
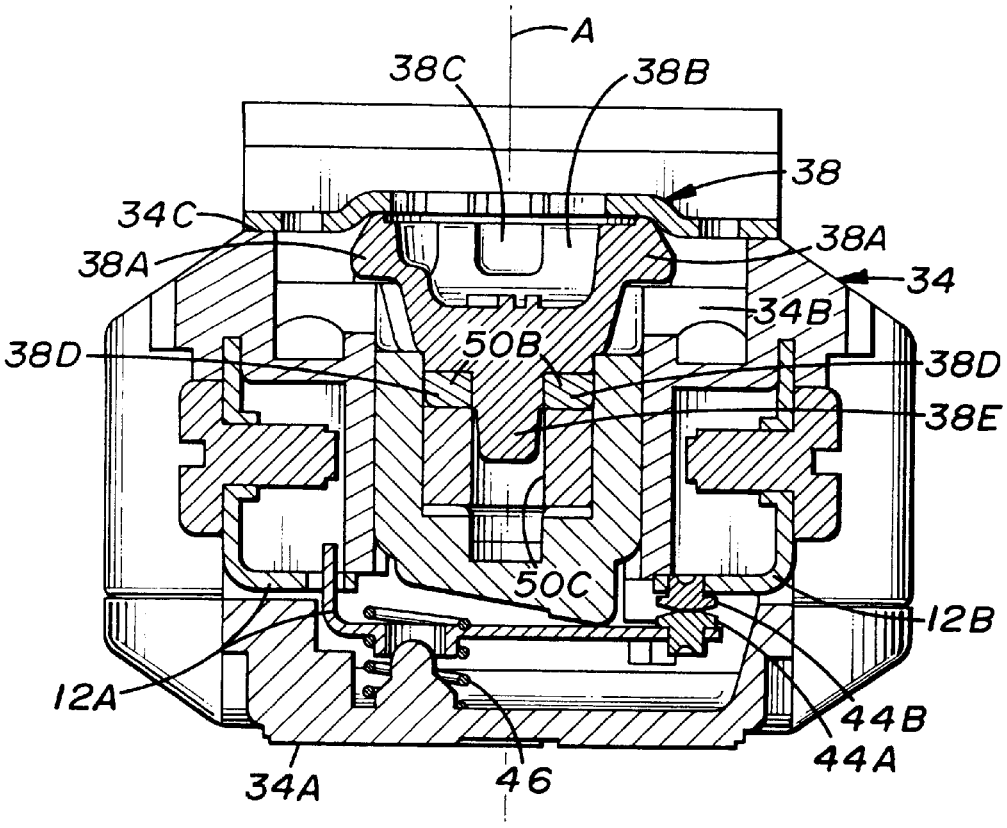
FIG. 41 is a longitudinal sectional view of the assembly taken along line 41—41 of FIG. 40.

Referring now to FIGS. 2, 4, 5 and 17 to 42, the rotary disconnect assembly 18 of the switch device 10 includes a main base 34, the plurality of pairs of electrical contact terminals 12A, 12B, a main cam follower 36 and a main cam actuator 38. As seen in FIGS. 2, 4, 5, 19, 39, 40 and 41, the main base 34 of the assembly 18 is stationarily supported in the housing 14 below the inner coupler portion 16B of the handle 16 by any suitable means, such as a yoke member 40 as seen in FIGS. 2, 4, 5, 17 and 18. The yoke member 40 has an U-shaped configuration and is attached at its opposite upper ends 40A to the underside of the cover end panel 26 of the housing 14 by a pair of yoke mounting screws 42, as best seen in FIG. 2. The main base 34 is disposed within the yoke member 40 and attached thereto by corner fasteners 43, such as rivets, as best seen in FIGS. 4 and 5.

Referring to FIGS. 4 and 39 to 42, each of the pairs of contact terminals 12A, 12B of the assembly 18 have respective contact elements 44A, 44B fixed thereon. The contact terminals 12A, 12B are respectively movably and stationarily mounted on the main base 34 for undergoing relative movement with respect to one another in a direction, as represented by arrow B, generally along or parallel to the longitudinal axis A of the handle 16 so as to switch their respective contact elements 44A, 44B between opened and closed conditions. Also, the movable contact terminal 12A of each pair is biased by a spring 46, located between a bottom 34A of the main base 34 and the movable contact terminal 12A, to move relative to the stationary contact terminal 12B such that their respective contact elements 44A, 44B normally assume the closed condition.

Figure 42:
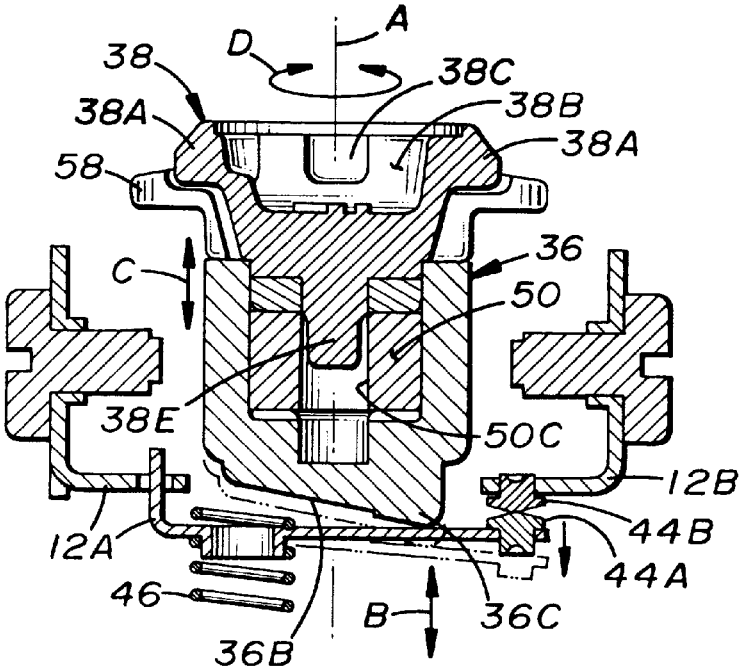
FIG. 42 is a longitudinal sectional view similar to that of FIG. 41 with the main base and yoke member omitted.

Referring to FIGS. 4 and 34 to 42, the main cam follower 36 is movably supported within a cavity 34B of the main base 34 for undergoing reciprocable linear movement between the bottom 34A of the main base 34 and a top 34C thereof in the direction of a double headed arrow C along or generally parallel to the longitudinal axis A of the handle 16 and toward and away from the movable contact terminal 12A so as to produce movement of movable contact terminal 12A relative to the stationary contact terminal 12B such that the respective contact elements 44A, 44B thereof are switched between the closed and opened conditions, as seen in solid and dashed line forms in FIG. 42. More particularly, the main cam follower 36 in linearly moving toward the movable contact terminal 12A engages the movable contact terminal 12A and moves it downward away from the stationary contact terminal 12B such that the respective contact elements 44A, 44B thereof are spaced apart and thus assume the opened condition whereas the main cam follower 36 in linearly moving away from the movable contact terminal 12A allows the movable contact terminal 12A, due to its spring bias, to move upward toward the stationary contact terminal 12B such that the respective contact elements 44A, 44B thereof engage one another and thus assume the closed condition. The main cam follower 36 is undercut at its opposite lateral ends 36A and supported thereunder by a pair of upright springs 48 which seat on the bottom 34A of the main base 34 and bias the main cam follower 36 to an upper non-depressed position in which the respective contact elements 44A, 44B assume their closed condition. The main cam follower 36 has respective laterally spaced apart inclined lower surfaces 36B defining tips 36C which engage only small surface areas of the movable contact terminals 12A near their contact elements 44A in order to move the movable contact terminals 12A through short distances away from the stationary contact terminals 12B that are sufficient to open the contact elements 44A, 44B.

Referring to FIGS. 4, 5, 20 to 24 and 39 to 42, the main cam actuator 38 of the assembly 18 is rotatably supported upon the top 34C of the main base 34 by oppositely protruding peripheral tabs 38A formed on the main cam actuator 38 which overlie the top 34C of the main base 34. The main cam actuator 38 is thereby disposed between the main cam follower 36 therebelow and the inner coupler portion 16B of the handle 16 thereabove. The main cam actuator 38 has an upper coupler portion in the form of a depression or recess 38B having circumferentially spaced peripheral pockets 38C which are complementary in configuration to and thus capable of receiving therein the inner coupler portion 16B and lugs 16C of the handle 16. The upper coupler portion 38B of the main cam actuator 38 is aligned with and faces toward the inner coupler portion 16B of the handle 16 so as to allow the upper coupler portion 38C of the main cam actuator 38 and the inner coupler portion 16B of the handle 16 to directly or indirectly intercouple with one another such that the main cam actuator 38 will undergo rotation with the handle 16 in the direction of an arrow D about the longitudinal axis A of the handle 16 and thereby correspondingly produce the desired reciprocal linear movement of the main cam follower 36 in the direction C along or generally parallel to the longitudinal axis A of the handle and thereby switch the respective contact elements 44A, 44B of the contact terminals 12A, 12B between the closed and opened conditions as the handle 16 is rotated between its on and off positions. The main cam follower 36 may have cam surfaces formed directly thereon which engage with complementary cam surfaces on the main cam actuator 38 so as to produce linear movement of the main cam follower 36 in response to rotary movement of the main cam actuator 38. Alternatively, as shown in FIGS. 4, 25 to 29, 41 and 42, a cam follower insert 50 having a pair of tongues 52 protruding in opposite directions from opposite sides 50A of the insert 50 are received within a pair of opposite grooves 54 defined in opposite side walls of an slot 56 formed in the main cam follower 36. The insert 50 has upper cam surfaces 50B formed around a central opening 50C therein which directly or indirectly intercouple with lower cam surfaces 38D formed around a central shaft 38E on the main cam actuator 38. In such manner, the main cam actuator 38 is directly or indirectly intercoupled with the main cam follower 36.

Referring to FIGS. 4, 30 to 33, 39 and 40, the assembly 18 further includes a pair of lateral cam followers 58 disposed adjacent to opposite sides of the main cam actuator 38 and having respective protrusions 60 formed on and extending from inner sides 58A of the lateral cam followers 58 toward one another. Also the assembly 18 includes means in the form of a pair of springs 62 disposed between lateral end portions 34D of the main base 34 and outer sides 58B of the respective lateral cam followers 58 for biasing the lateral cam followers 58 toward and into engagement with the opposite sides of the main cam actuator 38. The main cam actuator 38 further has respective projections 64 formed on and extending outwardly from the opposite sides of the main cam actuator 38 in opposite directions such that upon rotation of the handle 16 and the main cam actuator 38 therewith to a rotated position, such as the off position of the handle 16, so as to switch the respective contact elements 44A, 44B of the contact terminals 12A, 12B to one of the closed and opened conditions, such as the opened conditions, the projections 64 of the main cam actuator 38 engage with and move past the respective protrusions 60 on the lateral cam followers 58 so as to releasably retain the main cam actuator 38 and thus the handle 16 at the rotated position until the operator deliberately reverse rotates the handle 16 so as to disengage the projections 64 of the main cam actuator 38 from the respective protrusions 60 on the lateral cam followers 58. The biasing of the cam followers 58 toward the opposite sides of the main cam actuator 38 by the springs 62 provide the means by which the main cam actuator 38 and handle 16 are retained at the rotated position.

Referring to FIGS. 4 and 6 to 16, the switch device 10 optionally may include at least one and preferably a pair of auxiliary switches 66. When the auxiliary switches 66 are utilized, the switch device 10 employs an auxiliary base 68 to support the auxiliary switches 66 and a cam shaft adapter 70 to actuate the auxiliary switches 66 and to intercouple and transmit the rotary motion of the handle 16 to the main cam actuator 38 of the assembly 18. The auxiliary base 68 is supported on and attached by screws 72 to the yoke member 40 within the housing 14 and below the inner coupler portion 16B of the handle 16. The cam shaft adapter 70 is rotatably supported within the auxiliary base 66 and has an upper end portion 70A coupled to the inner coupler portion 16B of the handle 16 such that the cam shaft adapter 70 will rotate with the handle 16. The auxiliary switches 66 are mounted on the auxiliary base 68 adjacent to opposite sides of the cam shaft adapter 70 and switched by the cam shaft adapter 70 between on and off conditions in response to rotational movement of the handle 16 between the on and off positions. The cam shaft adapter 70 also has an opposite lower end portion 70B facing toward and coupled with the upper coupler portion 38B of the main cam actuator 38 such that the cam shaft adapter 70 intercouples the handle 16 with the main cam actuator 38. Thus, when the auxiliary switches 66 are utilized, the main cam actuator 38 is indirectly coupled to the handle 16 such that the cam shaft adapter 70 transmits the rotary motion from the handle 16 to the main cam actuator 38. When the auxiliary switches 66 are omitted, the main cam actuator 38 is directly coupled to the handle 16 and directly receives the rotary motion therefrom.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A rotary disconnect switch device, comprising:

(a) a housing;

(b) a handle having a longitudinal axis of rotation and being mounted to said housing for undergoing rotatable movement about said longitudinal axis between on and off positions relative to said housing, said handle having an outer knob portion disposed exteriorly of said housing for gripping to turn said handle and an inner coupler portion disposed interiorly of said housing; and (c) a rotary disconnect assembly supported in said housing below said handle, said assembly including (i) a main base, (ii) means for stationarily supporting said main base in said housing below said inner coupler portion of said handle, (iii) at least one pair of electrical contact terminals having respective contact elements and being respectively movably and stationarily mounted on said main base for undergoing relative movement with respect to one another in a direction generally along said longitudinal axis of said handle so as to switch said respective contact elements of said contact terminals between closed and opened conditions, (iv) a main cam follower movably supported on said main base for undergoing reciprocable linear movement along said longitudinal axis of said handle toward and away from said movable contact terminal so as to produce movement thereof relative to said stationary contact terminal such that said respective contact elements are switched between said closed and opened conditions, and (v) a main cam actuator rotatably supported on said main base between said main cam follower and said inner coupler portion of said handle and having an upper coupler portion facing toward said inner coupler portion of said handle and intercoupled therewith such that said main cam actuator will undergo rotation about said longitudinal axis with rotation of said handle and respectively produce said reciprocal linear movement of said main cam follower along said longitudinal axis of said handle and thereby switch said respective contact elements of said contact terminals between said closed and opened conditions as said handle is rotated between said on and off positions.

2. The device as recited in claim 1, wherein said movable contact terminal is biased relative to said stationary contact terminal such that said respective contact elements thereof normally assume one of said closed and opened conditions.

3. The device as recited in claim 2, wherein said main cam follower is adapted to engage and move said movable contact terminal relative to said stationary contact terminal such that said respective contact elements thereof assume the other of said closed and opened conditions.

4. The device as recited in claim 3, wherein said main cam follower has at least one inclined lower surface adapted to engage and move said movable contact terminal relative to said stationary contact terminal.

5. The device as recited in claim 1, wherein said means for stationarily supporting said main base in said housing is a yoke member having a generally U-shaped configuration.

6. The device as recited in claim 1, wherein said rotary disconnect assembly further includes:

a pair of lateral cam followers disposed on opposite sides of said main cam actuator and having respective protrusions formed on and extending from inner sides of said lateral cam followers toward one another; and means for biasing said lateral cam followers toward said opposite sides of said main cam actuator, said main cam actuator having projections formed on and extending outwardly from opposite sides of said main cam actuator in opposite directions such that upon rotation of said handle and said main cam actuator therewith to a rotated position so as to switch said respective contact elements of said contact terminals to one of said closed and opened conditions said projections of said main cam actuator engage with said respective protrusions on said lateral cam followers so as to releasably retain said main cam actuator and said handle at said rotated position.

7. The device as recited in claim 6, wherein said means for biasing said lateral cam followers toward said opposite sides of said main cam actuator is a pair of springs disposed between side portions of said main base and outer sides of said lateral cam follower members.

8. The device as recited in claim 1, wherein said rotary disconnect assembly further includes a plurality of pairs of said electrical contact terminals.

9. The device as recited in claim 1, wherein said rotary disconnect assembly further includes a cam follower insert intercoupling said main cam actuator with said main cam follower.

10. A rotary disconnect switch device, comprising:

(a) a housing;

(b) a handle having a longitudinal axis of rotation and being mounted to said housing for undergoing rotatable movement about said longitudinal axis between on and off positions relative to said housing, said handle having an outer knob portion disposed exteriorly of said housing for gripping to turn said handle and an inner coupler portion disposed interiorly of said housing;

(c) an auxiliary base supported in said housing below said innercoupler portion of said handle;

(d) a cam shaft adapter rotatably supported in said auxiliary base and having one end portion coupled to said inner coupler portion of said handle; and (f) a rotary disconnect assembly supported in said housing below said handle, said assembly including (i) a main base, (ii) means for stationarily supporting said main base in said housing below said inner coupler portion of said handle, (iii) at least one pair of electrical contact terminals having respective contact elements and being respectively movably and stationarily mounted on said main base for undergoing relative movement with respect to one another in a direction generally along said longitudinal axis of said handle so as to switch said respective contact elements of said contact terminals between closed and opened conditions, (iv) a main cam follower movably supported on said main base for undergoing reciprocable linear movement along said longitudinal axis of said handle toward and away from said movable contact terminal so as to produce movement thereof relative to said stationary contact terminal such that said respective contact elements are switched between said closed and opened conditions, and (v) a main cam actuator rotatably supported on said main base between said main cam follower and an opposite end portion of said cam shaft adapter and having an upper coupler portion facing toward said opposite end portion of said cam shaft adapter and coupled therewith such that said main cam actuator will undergo rotation with said handle and said cam shaft adapter about said longitudinal axis of said handle and respectively produce said reciprocal linear movement of said main cam follower along said longitudinal axis of said handle and thereby switch said respective contact elements of said contact terminals between said closed and opened conditions as said handle is rotated between said on and off positions.

11. The device as recited in claim 10, further comprising:

at least one auxiliary switch mounted on said auxiliary base adjacent to said cam shaft adapter and switched by said cam shaft adapter between on and off conditions in response to rotational movement of said handle between said on and off positions.

12. The device as recited in claim 10, further comprising:

a pair of auxiliary switches mounted on said auxiliary base adjacent to opposite sides of said cam shaft adapter and switched by said cam shaft adapter between on and off conditions in response to rotational movement of said handle between said on and off positions.

13. The device as recited in claim 10, wherein said movable contact terminal is biased relative to said stationary contact terminal such that said respective contact elements thereof normally assume one of said closed and opened conditions.

14. The device as recited in claim 13, wherein said main cam follower is adapted to engage and move said movable contact terminal relative to said stationary contact terminal such that said respective contact elements thereof assume the other of said closed and opened conditions.

15. The device as recited in claim 14, wherein said main cam follower has at least one inclined lower surface adapted to engage and move said movable contact terminal relative to said stationary contact terminal.

16. The device as recited in claim 10, wherein said means for stationarily supporting said main base in said housing is a yoke member having a generally U-shaped configuration.

17. The device as recited in claim 10, said rotary disconnect assembly further includes:

a pair of lateral cam followers disposed on opposite sides of said main cam actuator and having respective protrusions formed on and extending from inner sides of said lateral cam followers toward one another; and means for biasing said lateral cam followers toward said opposite sides of said main cam actuator, said main cam actuator having projections formed on and extending outwardly from opposite sides of said main cam actuator in opposite directions such that upon rotation of said handle and said main cam actuator therewith to a rotated position so as to switch said respective contact elements of said contact terminals to one of said closed and opened conditions said projections of said main cam actuator engage with said respective protrusions on said lateral cam followers so as to releasably retain said main cam actuator and said handle at said rotated position.

18. The device as recited in claim 17, wherein said means for biasing said lateral cam followers toward said opposite sides of said main cam actuator is a pair of springs disposed between side portions of said main base and outer sides of said lateral cam follower members.

19. The device as recited in claim 10, wherein said rotary disconnect assembly further includes a plurality of pairs of said electrical contact terminals.

20. The device as recited in claim 10, wherein said rotary disconnect assembly further includes a cam follower insert intercoupling said main cam actuator with said main cam follower.

* * * * *